US007476107B2

(12) United States Patent
Liao

(10) Patent No.: US 7,476,107 B2
(45) Date of Patent: Jan. 13, 2009

(54) SOCKET CONNECTOR WITH RETAINING DEVICE

(75) Inventor: Fang-Jun Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/899,192

(22) Filed: Sep. 4, 2007

(65) Prior Publication Data

US 2008/0057750 A1 Mar. 6, 2008

(30) Foreign Application Priority Data

Sep. 1, 2006 (CN) ..... 2006 2 0075899 U

(51) Int. Cl.
*H01R 12/00* (2006.01)

(52) U.S. Cl. ..... 439/71

(58) Field of Classification Search ..... 439/67, 439/68, 69, 70, 71, 331, 903
See application file for complete search history.

(56) References Cited

U.S. PATENT DOCUMENTS

RE31,114 E * 12/1982 Berg ..... 439/71
4,830,623 A * 5/1989 Owens et al. ..... 439/71
5,145,411 A * 9/1992 Pastal et al. ..... 439/598
5,227,959 A * 7/1993 Rubinstein et al. ..... 361/785
6,570,398 B2 * 5/2003 Murphy et al. ..... 324/755
7,090,507 B2 * 8/2006 Wertz et al. ..... 439/68
2005/0239302 A1 * 10/2005 Wada ..... 439/71

* cited by examiner

*Primary Examiner*—T C Patel
*Assistant Examiner*—Vladimir Imas
(74) *Attorney, Agent, or Firm*—Wei Te Chung

(57) ABSTRACT

A socket connector (100) includes an insulative housing (1) and a frame (3). The housing defines a mating interface (101), a mounting interface (102) opposite to the mating interface and periphery faces between the mating interface and the mounting interface. The frame has an opening (31) therein to accommodate the housing. At least one retaining device (11) includes a stopper portion (111) and a resilient claw portion (113) unitarily formed on the periphery face of the housing. One face of the frame is supported by the stopper portion and the opposite face is abutted against by the resilient claw potion while the housing is assembled in the opening of the frame.

12 Claims, 11 Drawing Sheets

SOCKET CONNECTOR WITH RETAINING DEVICE

BACKGROUND OF THE INVENTION

1. Field of the Invention

The present invention relates to a socket connector, and particularly to a socket connector for electrically connecting an IC package to a printed circuit board (PCB).

2. Description of Related Arts

FIG. 11 shows a conventional socket connector 1' for connecting an IC package to a PCB. The connector includes an insulating housing 2' with a plurality of conductive terminal 6' arranged therein, a metal reinforcing plate or stiffener 3' attached to a bottom face of the housing and surrounding the housing, a cover 5' and a lever 4'. The housing has a rectangular shape with ribs 23' extending upright therefrom for interengaging with the inner side of the reinforcing plate so as to retain the housing in the plate. The lever 4' is pivotally supported on an end of the plate and the cover 5 is pivotally retained on another ends opposite to said end of the plate. The lever having a cam portion to press toward a free end of the cover to lock the cover to the housing when the IC package is received in the housing.

The engagement of the housing and the plate restricts only in one direction and limits only one dimensional movement of the housing with respect to the reinforcing plate, which will result in a loose engagement between the housing and the plate. Rendering a disengagement between the housing and the reinforcing plate after a period of time of usage.

Hence, a socket connector having improved retaining device is desired.

SUMMARY OF THE INVENTION

Accordingly, an object of the present invention is to provide a socket connector having improved retaining device to ensure an insulating housing in an frame, in which the housing is retained.

To achieve the above objects, a socket connector comprises an insulative housing and a frame. The housing defines a mating interface, a mounting interface opposite to the mating interface and outside faces between the mating interface and the mounting interface. The frame has an opening therein to accommodate the housing. At least one retaining device includes a stopper portion and a resilient claw portion unitarily on the periphery face of the housing. One face of the frame is supported by the stopper portion and the opposite face is abutted against by the resilient claw potion while the housing is assembled in the opening of the frame.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 7:
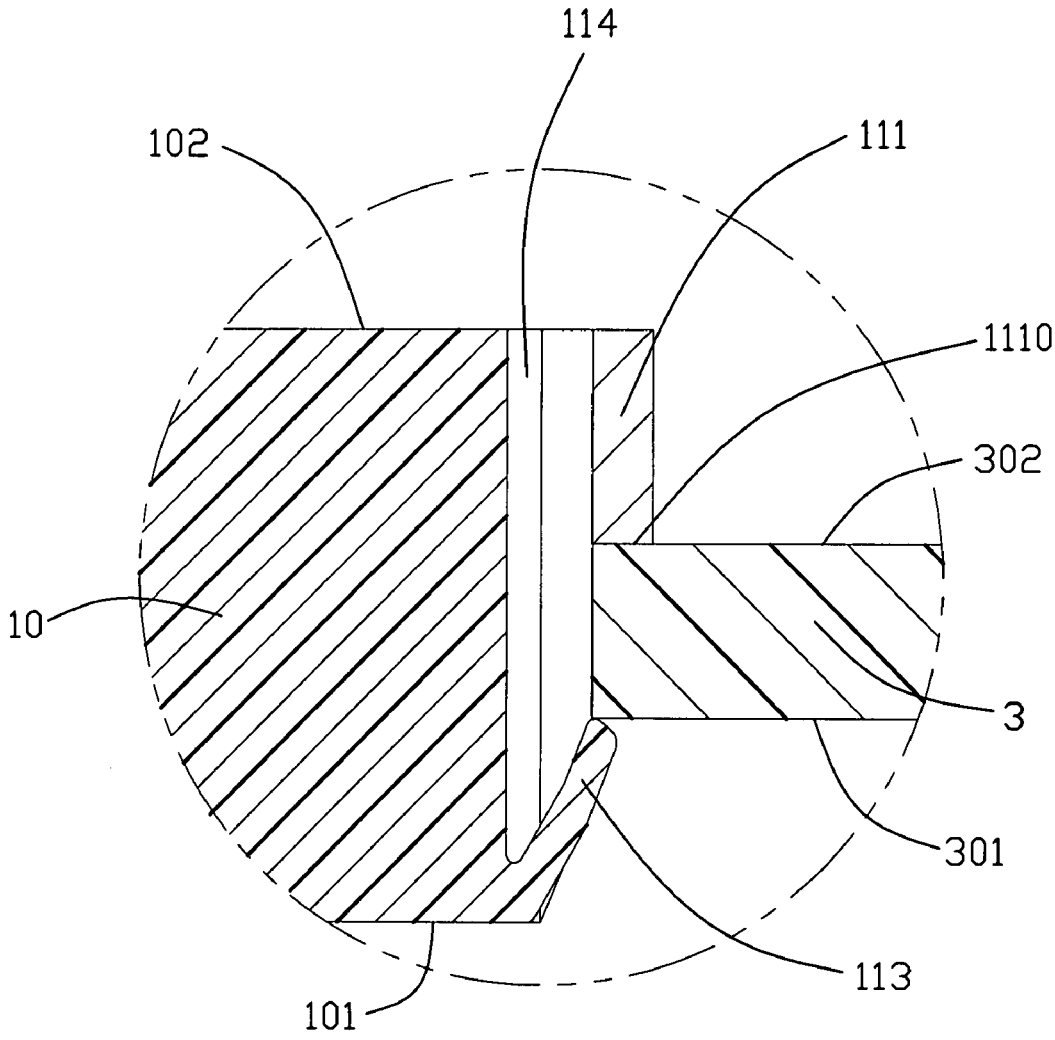
FIG. 7 is an enlarged cross-section view of the assembled connector, showing the engagement of the housing and the frame.
Figure 8:
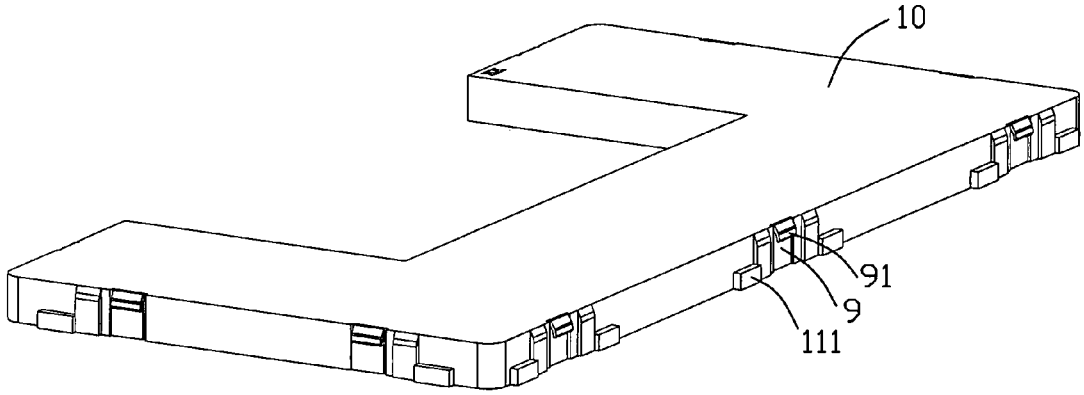
FIG. 8 is a perspective view of the housing of a second embodiment of the present invention.
Figure 9:
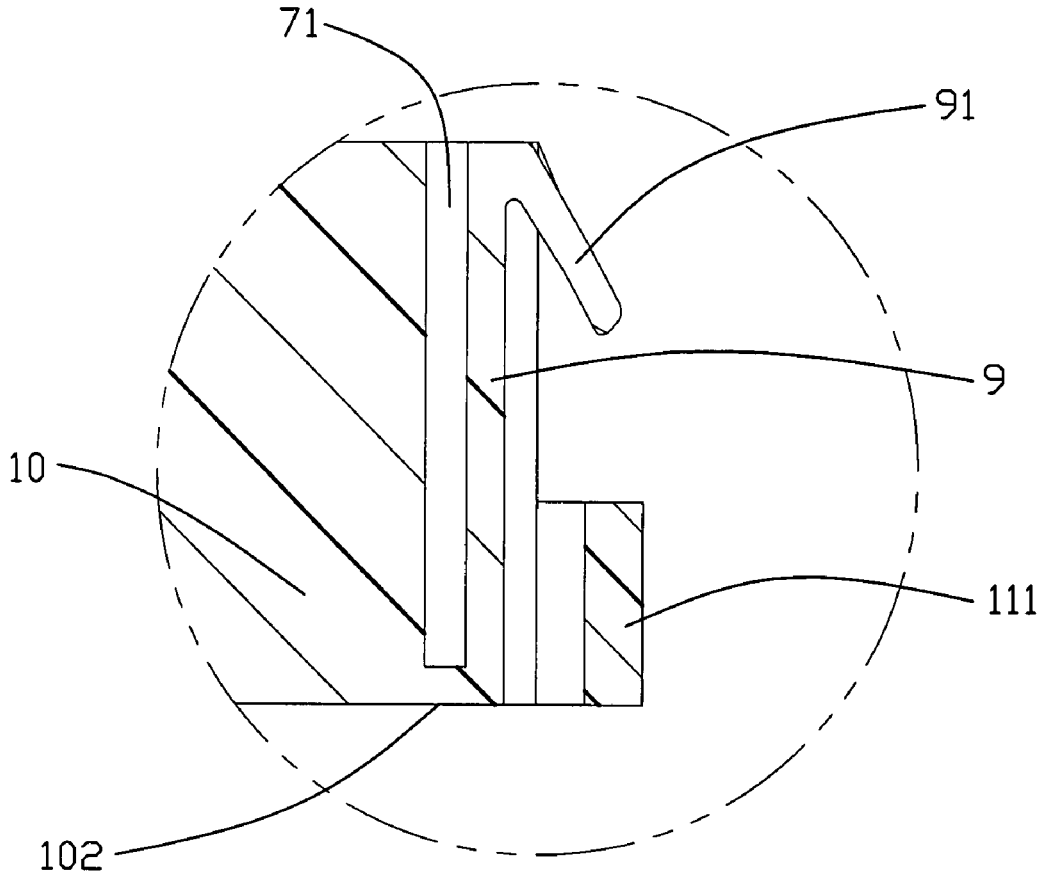
FIG. 9 is an enlarged cross-section view of housing of the connector shown in FIG. 8.
Figure 10:
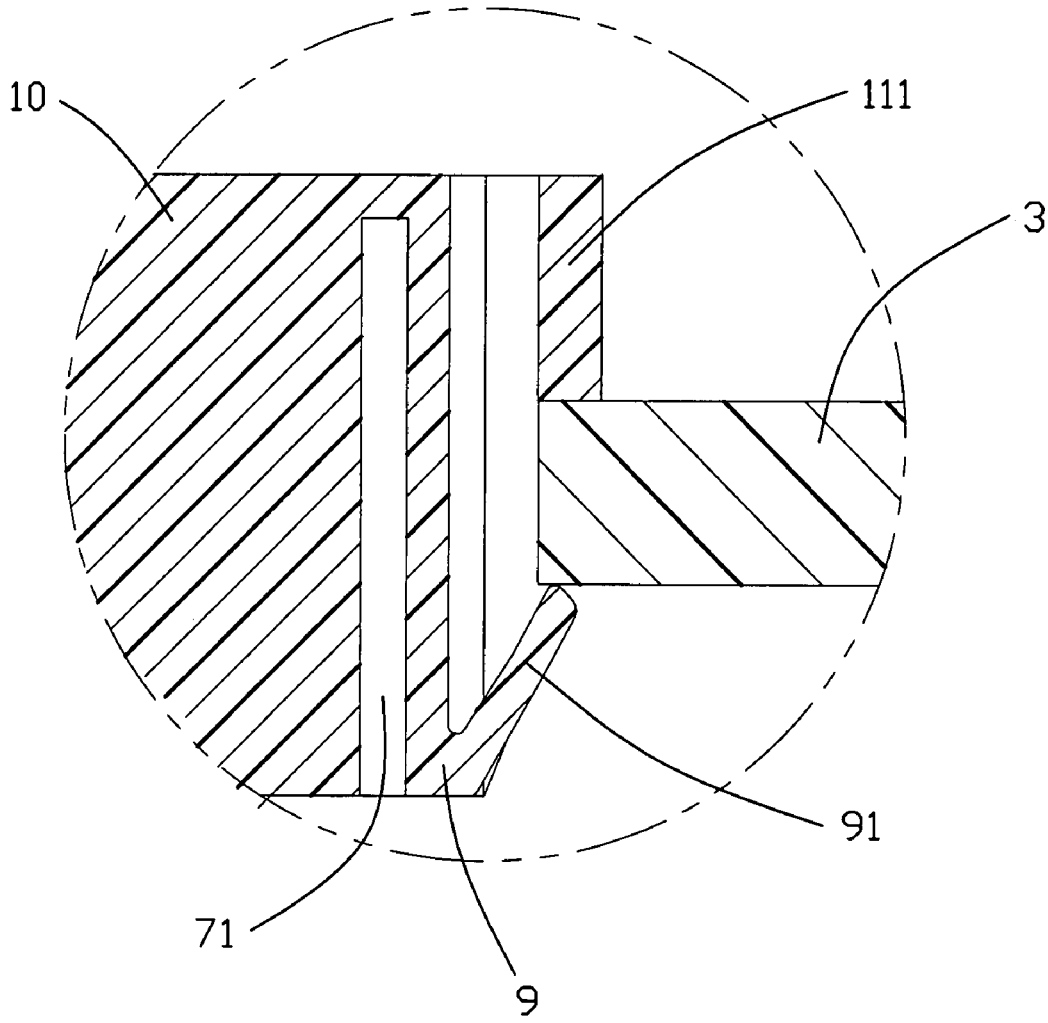
FIG. 10 is an enlarged cross-section view of the assembled connector shown in FIG. 8, showing the engagement of the housing and the frame.
Figure 11:
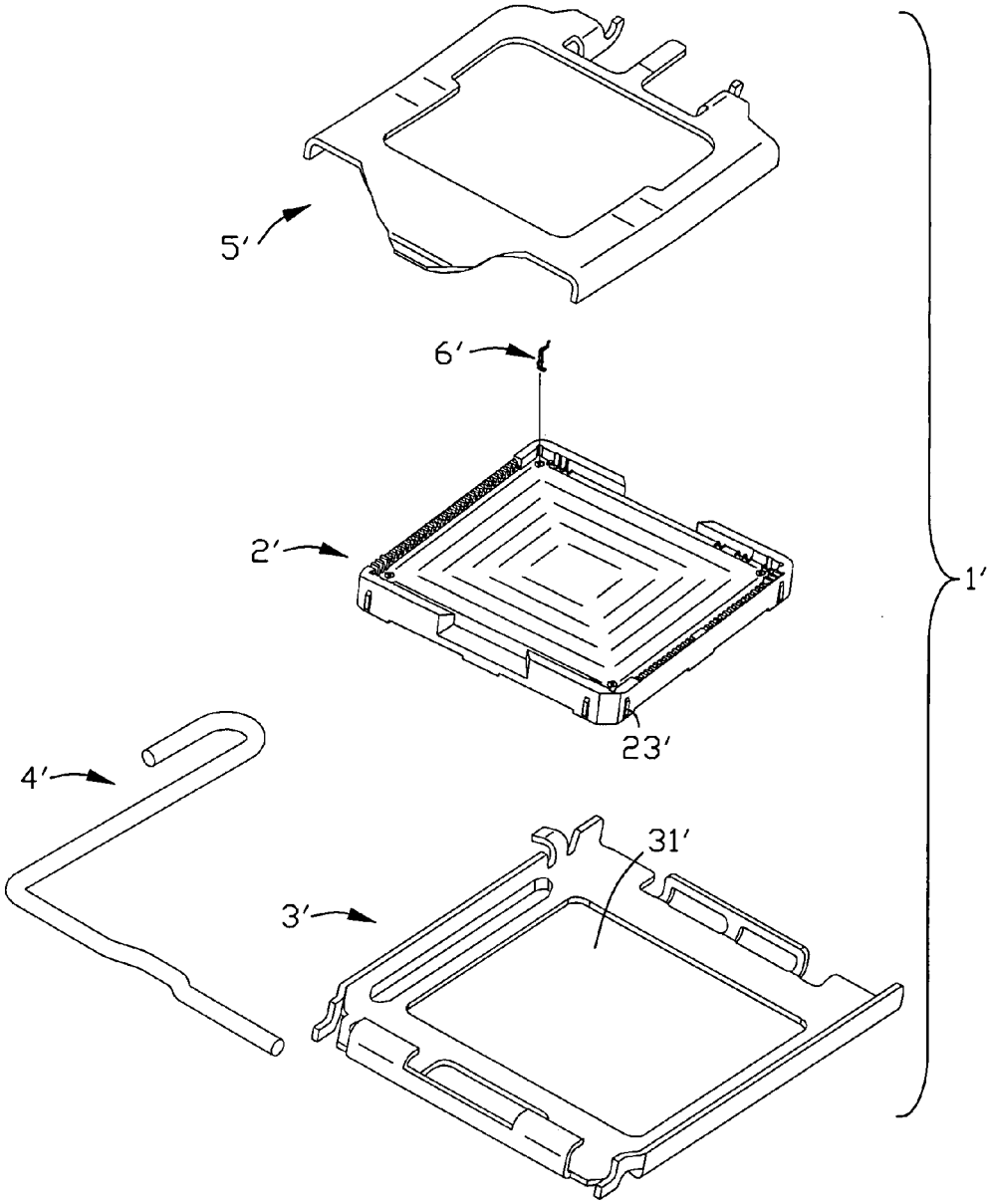
FIG. 11 is a perspective, exploded view of a conventional socket connector.

Further (detailed) description of the preferred embodiments of this present invention is set forth below along with the attached drawings. FIGS. 1~7 shows a first embodiment and FIGS. 8~10 shows a second embodiment made in accordance with the present invention.

Figure 1:
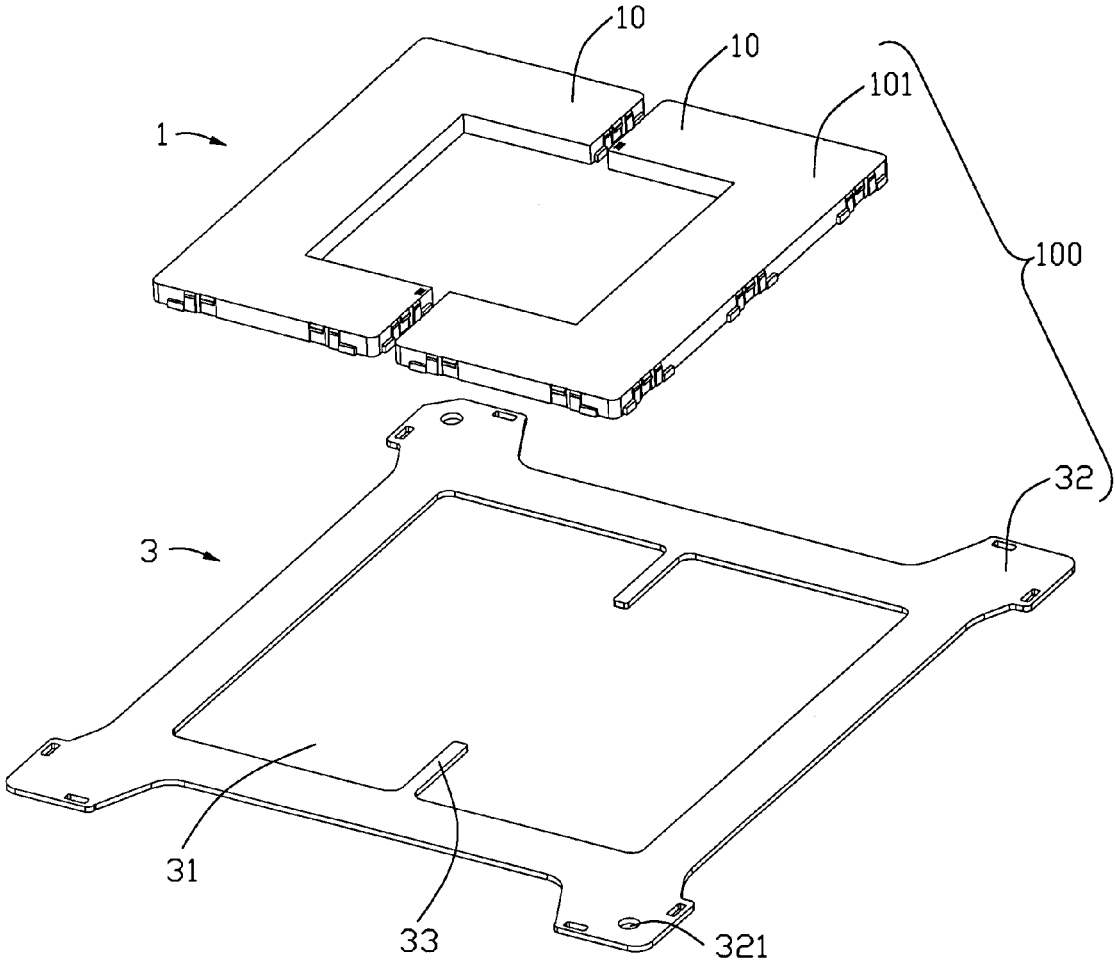
FIG. 1 is a perspective, exploded view of a socket connector of a first embodiment in accordance with the present invention.
Figure 5:
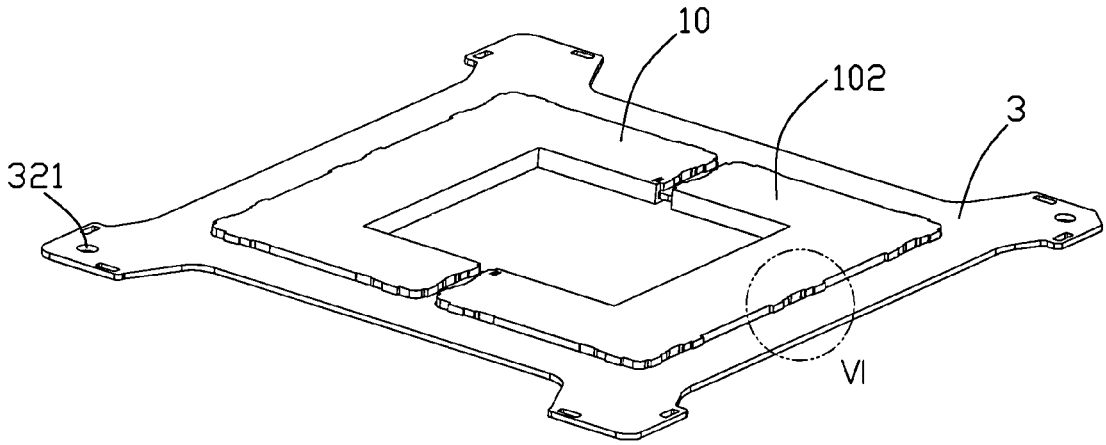
FIG. 5 is a bottom perspective, assembled view of the connector.
Figure 6:
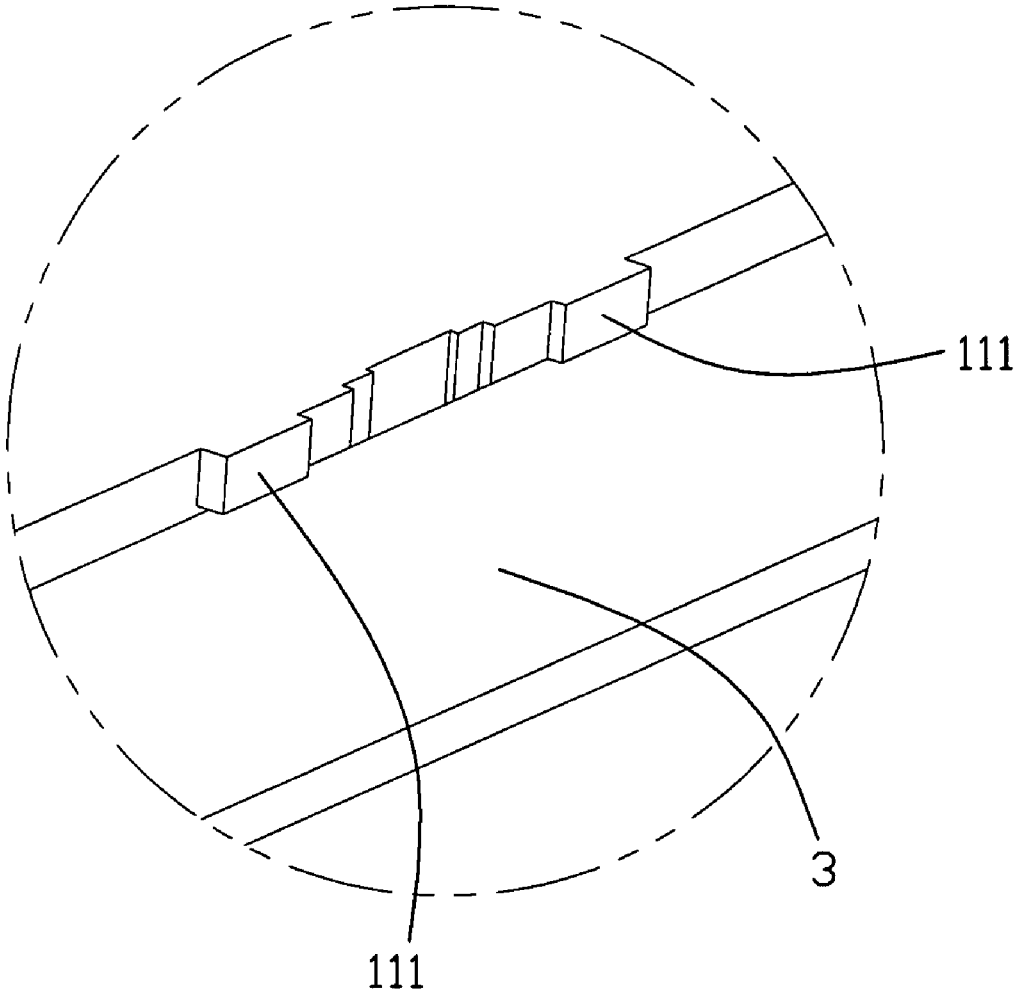
FIG. 6 is an enlarged view of circle 6 shown in FIG. 5.

Referring to FIG. 1, a socket connector 100 made in accordance with the present invention comprises a rectangular insulating housing 1 with a plurality of conductive terminal (not shown) arranged therein, a frame 3 in which the housing is retained. The frame 3 has a substantially rectangular board shape and defines an opening 31 in the center thereof. The frame 3 includes an assembling portion 32 at each of four corners and a though-hole 321 on the assembling portion used to retain the frame on a PCB. Two fingers 33 extend inward from two opposite middle inside edge of the opening into the opening 31 to divide the opening into two equivalent parts. The housing 1 is configured of two symmetrical base portions 10 securely received in said two parts of the opening 31, respectively. The top of the housing is served as a mating interface 101 and the opposite bottom face 102 is served as a mounting interface as shown in FIG. 5.

Figure 2:
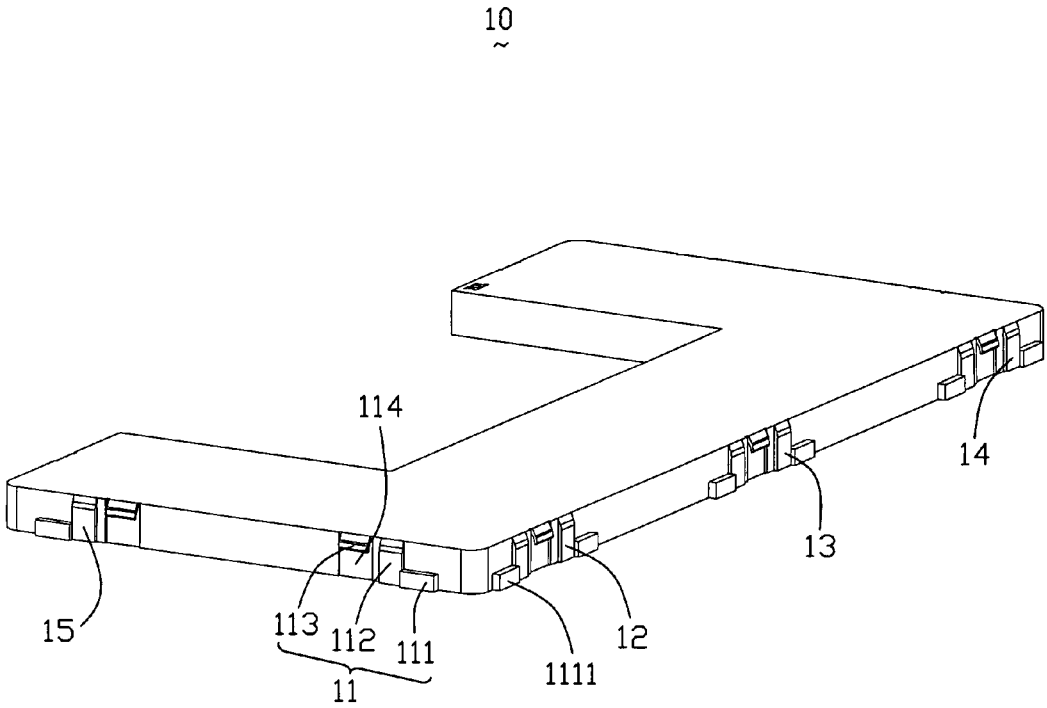
FIG. 2 is a perspective view of half part of the housing shown in FIG. 1.
Figure 3:
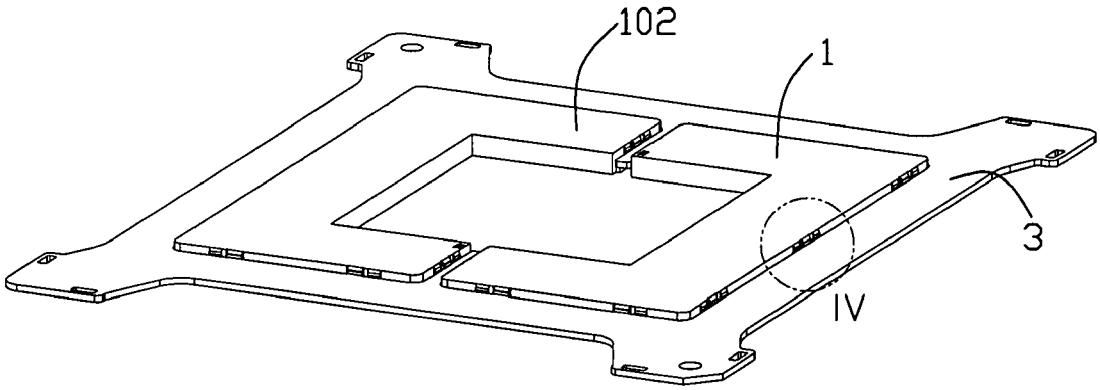
FIG. 3 is a top perspective, assembled view of the connector.
Figure 4:
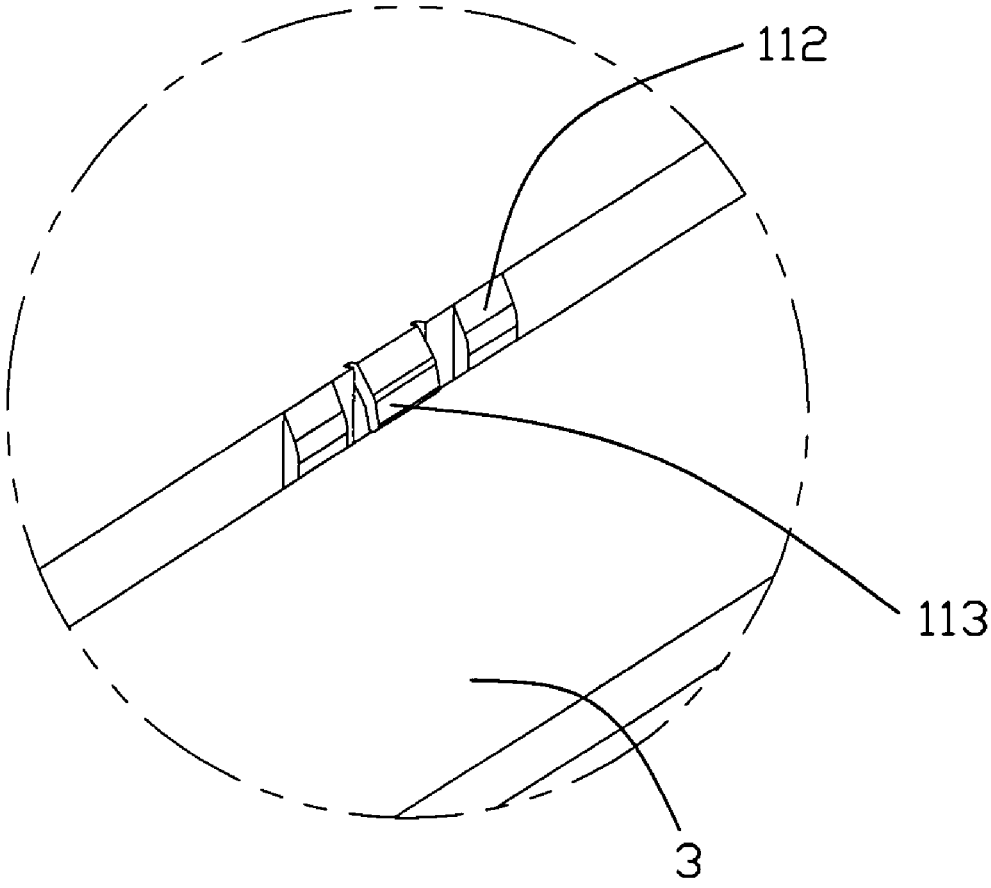
FIG. 4 is an enlarged view of circle 4 shown in FIG. 3.

Referring to FIG. 2, the housing 10 comprises a plurality of similar retaining devices 11~15 on an outside face thereof. A stopper portion or rib 111 transversely projects outward from a bottom edge of the outside face of the housing, i.e. the stopper rib extends parallel to the mounting interface. A guiding portion 112 or rib projects outward adjacent the stopper rib 111 without space, which extends upright and perpendicular to the stopper rib. Referring to FIG. 7, a recess 114 is defined on the outside of the housing perpendicular to the mounting interface 102 and a claw portion 113 projects outward from the top edge of recess 114. The claw potion is slant to the mounting interface 102 and have resilient capability. The distance between the end of the claw portion and a top surface 1110 of the stopper rib is substantially equal to the thickness of the frame 3. The guiding rib 112 sleekly joints to the outside of the housing. The retaining device 13, 14, 15 might further includes a second guiding rib 1121, if necessary.

The frame 3 is put on the housing from the top of the housing. The edge of the opening 31 of the frame 3 deform the resilient claw portion 113 inward and get across until below the free end of the claw portion, and then the claw portion restore. The top 301 of the frame is abut against the free end of the claw portion 113 and the bottom 302 of the frame is supported by the top face 1110 of the stopper rib 112. The guiding rib 112, 1121 can guide the frame onto the housing.

The configuration of the connector of the second embodiment is substantially similar to that of the first embodiment except the resilient claw portion 9. A cantilever arm 9 extends upward from the bottom edge of the outside of the housing. The arm 9 is spaced away the outside of the housing with a slot 71 and outward hook 91 slants to the mounting interface from the end of the arm to form a resilient claw portion. The frame 3 is disposed between the free end and the stopper portion 111. The slot 71 enlarges the deformation of the arm and increases the resilient of the arm.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A socket connector comprising:

an insulative housing arranged with a plurality of conductive terminal therein, defining a mating interface, a mounting interface opposite to the mating interface and periphery faces between the mating interface and the mounting interface;

a frame defining two opposite faces thereof and an opening therein to securely accommodate the insulative housing;

at least one retaining device comprising a stopper portion and a resilient claw portion unitarily formed on the periphery face of the housing;

wherein one face of the frame is supported by the stopper portion and the opposite face is abutted against the resilient claw portion while the housing is assembled in the opening of the frame;

wherein the claw portion projects slantways away the periphery faces;

wherein the stopper portion is arranged adjacent to the mounting interface and defines an upward face opposite to the mounting interface to support one face of the frame, and the claw resilient portion is arranged adjacent to the mating interface.

2. The socket connector as described in claim 1, wherein the periphery face of the housing projects a transverse rib adjacent to the mounting interface to form said stopper portion.

3. The socket connector as described in claim 1, wherein the upward face is parallel to the mounting interface.

4. The socket connector as described in claim 1, wherein the retaining device further comprises a guiding portion between the stopper portion and the claw portion along a direction parallel to the mating interface to guiding the frame surrounding the housing from the mating interface.

5. The socket connector as described in claim 1, wherein the claw portion is defined by a cantilever arm extending from the mounting portion to the mating interface at the periphery face of the housing.

6. The socket connector as described in claim 1, wherein the opening of the frame is divided into two parts by two fingers respectively oppositely extending into the opening from a middle inside edge of the opening and the housing includes two parts to be received in the opening.

7. A socket connector comprising:

a frame having a rectangular main body defining a large opening;

a pair of fingers extending from the main body into the large opening and forming two areas, along a first direction, in said large opening; and a pair of housings with a plurality of contacts therein, and assembled to the main body and the fingers in a supportably locking manner in said large opening;

wherein said fingers are spaced from each other, along a second direction perpendicular to said first direction, so as to cooperate with the pair of housings to commonly defines a small opening in said opening under a condition that said small opening is located between said pair of fingers in said second direction, and also between said pair of the housings in said first direction.

8. The socket as claimed in claim 7, wherein both said larger opening and small opening are essentially square.

9. The socket as claimed in claim 7, wherein said housing defines at least one resilient hook on a peripheral edge face.

10. The socket as claimed in claim 9, wherein said housing further defines at least one lead-in surface beside said hook.

11. The socket as claimed in claim 10, wherein a stopper is formed on the housing to cooperate with the hook for locking the housing in position with regard to the frame.

12. A socket connector comprising:

an insulative housing arranged with a plurality of conductive terminal therein, defining a mating interface, a mounting interface opposite to the mating interface and periphery faces between the mating interface and the mounting interface;

a frame defining two opposite faces thereof and an opening therein to securely accommodate the insulative housing;

at least one retaining device comprising a stopper portion and a resilient claw portion unitarily formed on the periphery face of the housing;

wherein one face of the frame is supported by the stopper portion and the opposite face is abutted against the resilient claw potion while the housing is assembled in the opening of the frame;

wherein the claw portion projects slantways away the periphery faces;

wherein the opening of the frame is divided into two parts by two fingers respectively oppositely extending into the opening from a middle inside edge of the opening and the housing includes two parts to be received in the opening.

* * * * *